United States Patent [19]

Cook

[11] 4,204,632

[45] May 27, 1980

[54] MAIL DEPOSITORY INDICATING ASSEMBLY

[76] Inventor: Hulet H. Cook, 1541 Leisure Dr., Apt. F-21, Bradenton, Fla. 33507

[21] Appl. No.: 969,973

[22] Filed: Dec. 15, 1978

[51] Int. Cl.[2] ..... B65D 91/00

[52] U.S. Cl. ..... 232/34; 232/36; 116/204

[58] Field of Search ..... 232/34, 36, 35; 116/204, 100

[56] References Cited

U.S. PATENT DOCUMENTS

| | | | |
|---|---|---|---|
| Re. 24,943 | 2/1961 | Skrobisch | 116/204 X |
| 337,796 | 3/1886 | Staus | 232/36 |
| 2,465,935 | 3/1949 | Scalia | 232/36 X |
| 3,344,980 | 10/1967 | Nagle | 232/36 X |

FOREIGN PATENT DOCUMENTS

| | | | |
|---|---|---|---|
| 1018338 | 10/1957 | Fed. Rep. of Germany | 116/204 |
| 783542 | 9/1957 | United Kingdom | 116/204 |

*Primary Examiner*—Roy D. Frazier
*Assistant Examiner*—Peter A. Aschenbrenner

[57] ABSTRACT

An indicating assembly designed to be used primarily with container assemblies of the type used for mail depositories installed in multi unit apartment houses, condominiums, or like multi unit dwellings. A switch installed in direct association with the opening of the main unit of the apartment complex, wherein the switch is interconnected in circuit between a power source and an electromagnetic indication device. Opening of the switch and thereby breaking of the circuit is caused by the post office delivery opening the main assembly normally required for the disposition of mail in the individual mail boxes or compartments. Breaking of the circuit causes disengagement of the electromagnetic device with a base element formed from magnetically attracted material such as metal. Disconnection of the electromagnetic device from the base element serves as an indication that the mail depository has been opened for the purpose of mail delivery thereby eliminating the need to make unnecessary trips from the various apartments or dwellings to the main bank of mail depository containers.

5 Claims, 5 Drawing Figures

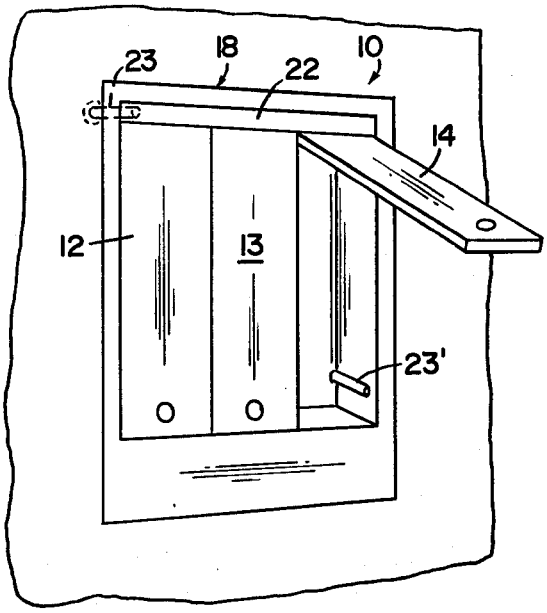
FIG. 1
FIG. 2
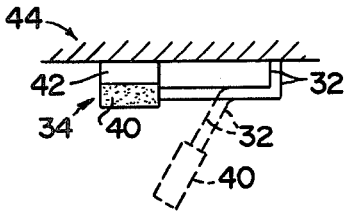
FIG. 3
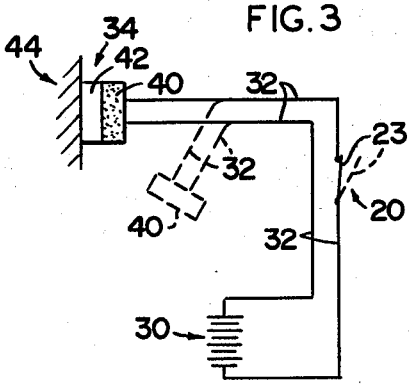
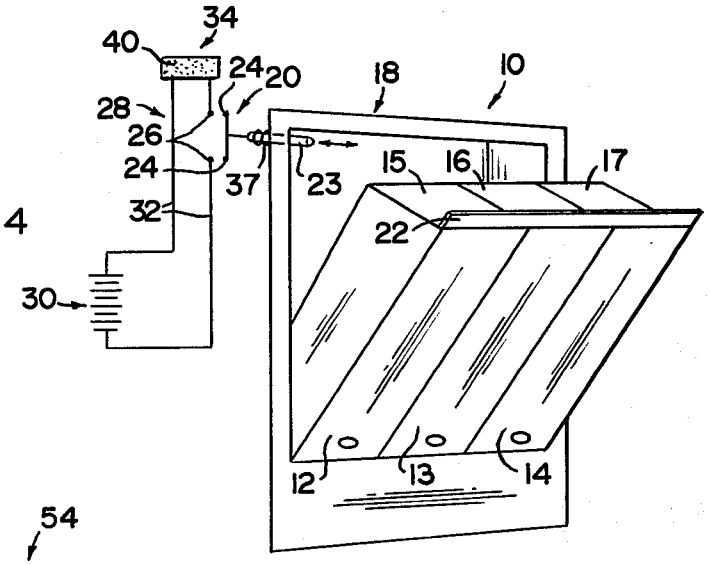
FIG. 4
FIG. 5
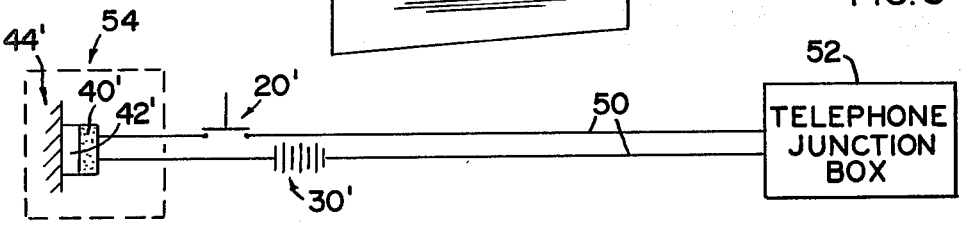

MAIL DEPOSITORY INDICATING ASSEMBLY

BACKGROUND OF THE INVENTION

1. Field of the Invention

An indication assembly of the type to be used to indicate predetermined activity with container assemblies specifically of the type used for the depository or collection of mail wherein the indication device, of predetermined design is located remote from the mail depository so as to clearly indicate activity at the mail depository.

2. Description of the Prior Art

For many years indication or signalling devices have been available which are specifically designed for use in combination with a mail depository or like container assembly specifically designed for the reception of any type article being delivered to a residence or business address. The delivery of mail is commonly accomplished on a daily basis wherein individual postal employees hand deliver mail to a specified container assembly or mailbox. In rural areas it is quite common for the mail depository to be located some distances from the actual resident. In such cases it is obviously inconvenient for a resident to leave his home to physically determine whether mail has been delivered at the remotely located mailbox. The prior art and/or existing signaling devices have been available to the general consumer to overcome this problem. Generally such devices include some type of sound or sight signaling device located within the house and triggered either mechanically or electrically upon the opening or manipulation of the mail depository itself. While some years ago such problems were primarily directed to rural type delivery routes, similar type problems are now arising in multiple dwelling units. Mail deliveries are becoming increasingly complicated because of the larger number of such multiple dwellings which are presently in use. These multiple dwellings contain larger number of apartments, condominiums and like residences located on numerous floors above ground level, where the mailboxes are normally positioned. Even where elevator service is available it is an obvious inconvenience for residents in such multi floor units to physically travel to the mailbox to determine if mail has in fact been delivered. It would therefore be a great advantage to residents in such multi dwelling units to determine whether mail had yet been delivered to the main mailbox array without physically leaving their apartment or residence.

Signal devices available in the prior art are disclosed in existing U.S. Pat. Nos. 1,019,554; 1,005,004; and 3,556,394. These prior art references are primarily designed for mail depositories used in rural areas where the resident has to physically leave the house and travel usually some distance in the open to physically determine whether mail has been delivered to the individual mail depository.

Similarly the U.S. Pat. Nos. to Scallia, 2,465,935 and Ucciardino, 3,819,109 are directed to signalling devices designed to be used with a mailbox array of the general type available in multi unit dwelling structures.

While, as set forth above, the structures disclosed in the aforementioned do indicate some type of contact or signalling device being used for the remote informing of manipulation with a mail depository structure, a vast majority of these devices are extremely complex and would significantly add to the overall cost of the mail depository structure both from a standpoint of installation and initial purchase of the signalling device.

Accordingly there is an obvious need in the industry for an indicating assembly of the type which can be readily adapted to existing, permanently installed array type mail depositories wherein the opening of the entire array by the postal employee is indicated to each of the residence in a multi unit or multi dwelling building for the purpose of eliminating the need of physically travelling from the individual unit down to the bottom floor or central location of the mail depository.

Such an indicating assembly should be capable of low cost initial purchase, easy installation and the utilization of existing components already maintained in the building or dwelling whenever possible. In addition the actual indicating portion of the indicating assembly located remote from the main mail depository array would be of extremely simple design so as to be long lasting and include a minimal amount of working parts such that the cost of installation and maintenance of such a device would be negligible.

SUMMARY OF THE INVENTION

An indicating assembly of the type to be used with a specific container arrangement. Such container arrangment, in the invention set forth hereinafter, is specifically related with regard to a plurality of mail compartments or an overall multi unit mail depository. In such an environment the indicating assembly of the present invention comprises a switch means disposed to be mounted in movable engagement with a predetermined portion of the container assembly of the present invention wherein the switch means will be activated upon predetermined movements of the predetermined portions of the container assembly.

The switch means defines, at least in part, a circuit means further comprising an indication means and a power source. The power source may be standard red cell or alternately DC dry cell batteries interconnected to a conventional electrical conductor. The conductor serves to interconnect the other components including the switch means and the indication means. The switch means is disposed in current interruptive position relative to and between the power source and the indication means. In such position, the opening of the switch means, again due to predetermined movement of portions of the container assembly causes a breaking of the circuit and a stopping of current flow from the power source to the indication means.

Alternately the conventional electrical conductors interconnecting the power source to the other portion of the circuit as aforementioned may be defined by the existing or previously installed telephone lines already maintained in the multi unit building structure in accordance with normal construction and design standards. In such an embodiment the additional power may be interconnected to predetermined portions of the telephone line so as to provide constant source of power, while the switch means is in its closed position so as to complete the defined circuitry which in turn provides a constant flow of current to the indication means for reasons which will be explained in greater detail hereinafter. In any event when the conductors are defined at least in part by existing telephone lines no additional installation would be required to interconnect the power source, switch means and indication means in the aforementioned manner.

An important structural feature of the present invention comprises the inclusion of the indication means. The indication means comprises at least one electromagnetic member disposed directly in circuitry and in direct current flow receiving relation from the power source. The electromagnetic element is connected to receive such current from the power source through the switch means which, as set forth above, is disposed in current interruptive relation between the power source and the electromagnetic element. The indication means further comprises a base element formed of the material capable of being magnetically attractive such as metal or the like. Accordingly when current is passed to the electromagnetic means a magnetic attraction is created between the base element and the electromagnetic element. Such attraction is maintained until current ceases to flow or is substantially reduced from the power source to the electromagnetic element. As generally pointed out above the current ceases to flow upon opening of the switch means thereby breaking the defined circuitry. The opening of the switch means occurs in turn by a predetermined movement of predetermined portions of the array of the container assembly. Such in turn occurs when the postal employee removes the entire array so as to reveal access to the interior of the various compartments in a multi mailbox in its array, commonly maintained in multi dwelling apartment buildings or the like. For overall purpose of the breaking of the connection between the electromagnetic element and the base element is to inform the residents of a given apartment or dwelling space that in fact the postal employee has attended to the delivery of mail as evidenced by the opening of the main mail array compartment and the breaking of the circuitry through the opening of a switch means. Upon closing of the main compartment array by the postal employee the switch means will again close thereby completing the circuit and continuing current flow to the electromagnetic means. The electrical conductors and major portions of the electromagnetic elements are sufficiently insulated so as to prevent any type of harm due to electric shock being exposed to the residents of the dwelling unit. Accordingly the switch is again closed to complete the circuitry after closing of the main mailbox array. Mere repositioning of the electromagnetic element on the base element will again establish removable attachment between the two due to the existence of current flow to the electromagnetic element.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a further understanding of the nature and objects of the invention, reference should be had to the following detailed description taken in connection with the accompanying drawings in which:

FIG. 1 is a perspective view of one application of the subject indicating assembly used to indicate manipulation of a multi unit mailbox array.

FIG. 2 is a detailed view showing details of the indication means of the present invention.

FIG. 3 is a schematic view showing details of the circuit means of the present invention.

FIG. 4 is a detailed view in partial schematic and isometric showing various embodiments of the present invention.

FIG. 5 is a schematic view showing details of embodiments of a circuit means of the present invention.

Similar reference characters refer to similar parts throughout the several views of the drawings.

DETAILED DESCRIPTION OF THE PREFERRED EMBODIMENT

As best shown in FIGS. 1 and 4 the subject indicating assembly is explained hereinafter with specific utilization in the environment of a container assembly generally indicated as 10 in the form of a multi unit 12, 13 and 14 mail compartment. In conventional fashion the overall array of the plurality of compartments 12, 13 and 14 are removable, as at a plurality of units to provide access through their open tops 15, 16 and 17 respectively, for the insertion of mail therein by a postal employee. The foundation generally indicated as 18 may represent any common building wall or like support base to house the overall array 10.

A predetermined portion of the overall array 10 is disposed in engageable relation with the switch means generally indicated as 20 in the indication assembly of the present invention. More specifically a border portion such as at 22 of the overall array or casing of the array is disposable into engagement with an activating switch finger 23. The switch means further includes contact points 24 designed to engage correspondingly positioned contact points 25 within the circuitry generally indicated as 28. The remaining portion of circuitry 28 comprises a power source generally indicated as 30 and comprising conventional DC batteries as represented. The power source 30 is disposed through conductors 32 to allow current flow from the power source 30 to the indication means generally indicated as 34.

When the switch means 20 is in its open position due to the displacement of the border portion 22 of the overall array 10 as shown in FIG. 4, current flow from power source 30 to the indication means 34 is halted. In the open position contacts 24 of the switch means 20 are disposed out of current flowing relation with the contacts 26 of the conductor means 32.

A biasing means 37 is disposed in engagement with the switch finger 23 so as to normally bias it in its open position relative to the remaining portions of the circuitry and particularly the conductors 32. Accordingly when the border 22 or any other predetermined portion of the overall array 10 is out of engagement with the finger 23, the biasing means 37 causes the finger element to automatically force the switch into its open position as best shown in FIG. 4. Reestablishment or engagement of the border portion 22 or any predetermined portion of the array containers 10 with the finger element 23 causes a closing of the switch with regard to the remainder of the circuitry 28 and a reestablishment of current flow through conductors 32 from power source 30 to the indicating means 34.

With regard to FIGS. 2, 3 and 4, the indication means of the subject invention comprises an electromagnetic element 40 disposed in direct circuitry and current receiving relation with the power source 30 through conductors 32. In addition, the indication means of the present invention comprises a base element 42 made from a material capable of magnetic attraction such as metal or the like. When current flows to the electromagnetic element 40, electromagnetic attraction maintains the attachment between element 40 and 42. However when the circuit is broken through the opening of switch means 20 the electromagnetic element 40 falls away, due to the force of gravity from the base element 42 which is affixedly mounted on a support surface 44 located in any convenient and observable location with regard to the residents of a given dwelling unit. The particular disposition of the conductor elements 32 allows the hanging support of the electromagnetic element 40 to separate after disengagement with the base element 42 due to a stopping of current flow at least temporarily from the power source 30 to the indication means 34.

With regard to FIG. 5 yet another embodiment of the present invention includes the conductor elements 50 being defined by existing telephone lines already installed in a given dwelling. Such telephone lines may originate from a conventional telephone junction box as at 52 and be disposed to extend from the junction box 52 to a given dwelling unit schematically indicated generally as at 54. In any event the switch means 20' by the power source 30' are a part of the circuitry further completed by electromagnetic element 42' base element 40'.

Another feature of the invention as represented in the embodiment of FIG. 5 is the provision of switch means 20' being connected into the rest of the circuit shown so as not to permanently interrupt the telephone circuit and any conversation thereon when finger 23 or 23' is activated to open switch means 20'. In addition such switch means 20' and the remainder of the circuitry can be electrically interconnected to deliver an audible signal or "click" over the telephone line to be detected during the conversation when switch means 20' is moved to its open position.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An indicating assembly of the type primarily designed for indication of opening of a container assembly, such as a mail depository at a location remote therefrom, said indicating assembly comprising: switch means positioned in engaging relation to a predetermined portion of the container assembly and movable between an open and closed position defining a circuit breaking and circuit making position respectively, a power source electrically connected to said switch means and indication means electrically interconnected to said power source and positioned at a predetermined location remote from the container assembly; circuit means at least partially defined by said power source, said switch means and said indication means being electrically interconnected by conductor means, said switch means connected in said circuit in current interruptive relation between said power source and said indication means and disposed to at least reduce current flow to said indication means upon predetermined displacement of the container assembly, said indication means comprising at least one base element and electromagnetic means, said conductor means disposed to electrically interconnect said power source to said electro magnetic means, said one base element formed from a magnetically attracted material; said electro magnetic means removably attached to said base element during current flow thereto from said power source due to electro magnetic attraction, said indication means disposed at said remote location and oriented to allow separation of said electro magnetic means from said one base element because of the force exerted thereon by gravity upon said switch means moving to an open, circuit breaking position and cessation of current flow from said power source to said electro magnetic means.

2. An indicating assembly as in claim 1 wherein said circuit means comprises in series, electrical connection by said conductor means of said power source, said switch means and said indication means, said switch means disposed in circuit breaking relation between said power source and said indication means, said switch means disposed for opening said circuit upon predetermined movement of the container assembly, thereby reducing current flow from said power source to said indication means.

3. An indicating assembly as in claim 2 wherein said conductor means comprises local, permanently installed telephone lines disposed between the proximity of the container assembly and said indication means.

4. An indicating assembly as in claim 1 wherein said base element is fixedly secured to a support surface in connectable relation to said electromagnetic means, whereby separation of said one base element and said electromagnetic means indicates opening of said switch means and predetermined movement of the container assembly.

5. An indicating assembly as in claim 1 further comprising a biasing means connected to bias said switch means into its normally circuit breaking position, said switch means disposed in engaging relation to allow opening of said switch means when the container assembly moves to a predetermined position.

* * * * *